US007743621B2

(12) United States Patent
Hu

(10) Patent No.: US 7,743,621 B2
(45) Date of Patent: Jun. 29, 2010

(54) MULTI-RANGE COMPOSITE-EVAPORATOR TYPE CROSS-DEFROSTING SYSTEM

(76) Inventor: Lung-Tan Hu, 25755 48th Avenue, Aldergrove, B.C. (CA) V4W1J6

( * ) Notice: Subject to any disclaimer, the term of this patent is extended or adjusted under 35 U.S.C. 154(b) by 0 days.

(21) Appl. No.: 12/381,657

(22) Filed: Mar. 16, 2009

(65) Prior Publication Data

US 2009/0173091 A1 Jul. 9, 2009

Related U.S. Application Data

(62) Division of application No. 11/311,085, filed on Dec. 20, 2005, now Pat. No. 7,614,249.

(51) Int. Cl.
*F25B 13/00* (2006.01)

(52) U.S. Cl. ..... 62/324.1; 62/324.6

(58) Field of Classification Search ..... 62/199–200, 62/277–278, 324.1, 324.5, 324.6
See application file for complete search history.

(56) References Cited

U.S. PATENT DOCUMENTS 2,960,840 A * 11/1960 Hosken et al. ..... 62/81
3,150,498 A * 9/1964 Blake ..... 62/81
4,691,527 A * 9/1987 Ikeda ..... 62/234
5,150,582 A * 9/1992 Gotou ..... 62/155
5,228,301 A * 7/1993 Sjoholm et al. ..... 62/84
5,465,591 A * 11/1995 Cur et al. ..... 62/439
6,276,158 B1 * 8/2001 Lowes et al. ..... 62/324.5
7,171,817 B2 * 2/2007 Birgen ..... 62/81
7,213,407 B2 * 5/2007 Hu ..... 62/324.5

* cited by examiner

*Primary Examiner*—William E Tapolcai

(57) ABSTRACT

The present invention provides a multi-range composite-evaporator type cross-defrosting system for continuous heating operation under an environment temperature range from 20 degree to negative 40 degree Celsius. Said system employs a combination of two defrosting methods under different temperature and humidity conditions; the first defrosting method is used for the outdoor temperature range of 20 degree Celsius to 0 degree Celsius, the second defrosting method is used in the outdoor temperature range of 10 degree Celsius to negative 40 degree Celsius, and a control system will adjust the appropriate threshold for switching between the two defrosting methods.

14 Claims, 6 Drawing Sheets

MULTI-RANGE COMPOSITE-EVAPORATOR TYPE CROSS-DEFROSTING SYSTEM

RELATED APPLICATION

This patent application is a divisional application of and claims priority from U.S. application Ser. No. 11/311,085, filed Dec. 20, 2005 now U.S. Pat. No. 7,614,249.

FIELD OF THE INVENTION

The present invention relates to a multi-range composite-evaporator type cross-defrosting system, more particularly to a heating or air-conditioning system that is capable of continuous operation under the outdoor temperature range of 20 degree Celsius to negative 40 degree Celsius.

The present invention can be applied on the fields of residential, agriculture, and industrial; more particularly, the present invention can be used on heating and air-conditioning purpose.

BACKGROUND OF THE INVENTION

The present invention is a divisional application of the patent application Ser. No. 11/311,085 filed on Dec. 20, 2005, entitled "Multi-range cross defrosting heat pump system and humidity control system."

In general, current heat pump system has very limited range of working temperatures due to the limitation and the operation efficiency of the compressor; however, in many circumstances, the environment temperature may vary from negative 40 degree to 20 degree Celsius, therefore it is main objective of the present invention to provide a multi-range cross defrosting heat pump capable of operating under a wide range of working environment temperature at high efficiency.

SUMMARY OF THE INVENTION

1. It is a primary object of the present invention to provide a multi-range composite-evaporator type cross-defrosting system capable of continuous operation under various ranges of temperature.

2. It is a second object of the present invention to provide a multi-range composite-evaporator type cross-defrosting system capable of continuous operation during the defrosting process.

3. It is another object of the present invention to provide an efficient defrosting control method of the multi-range composite-evaporator type cross-defrosting system, which is capable of cross-defrosting with the heat energy absorbed from the outdoor-air-flow and the heat energy generated from the compressor.

BRIEF DESCRIPTION OF THE DRAWINGS

FIG. 1A is an operation scheme of the first embodiment, in which all the composite-evaporators are operating with evaporation process.

FIG. 1B and FIG. 1C are the operation schemes of the first defrosting method of the first embodiment, which is also called as the cross-air defrosting process.

FIG. 1D and FIG. 1E are the operation schemes of the second defrosting method of the first embodiment, which is also called as the cross-refrigeration defrosting process.

Figure 1A:
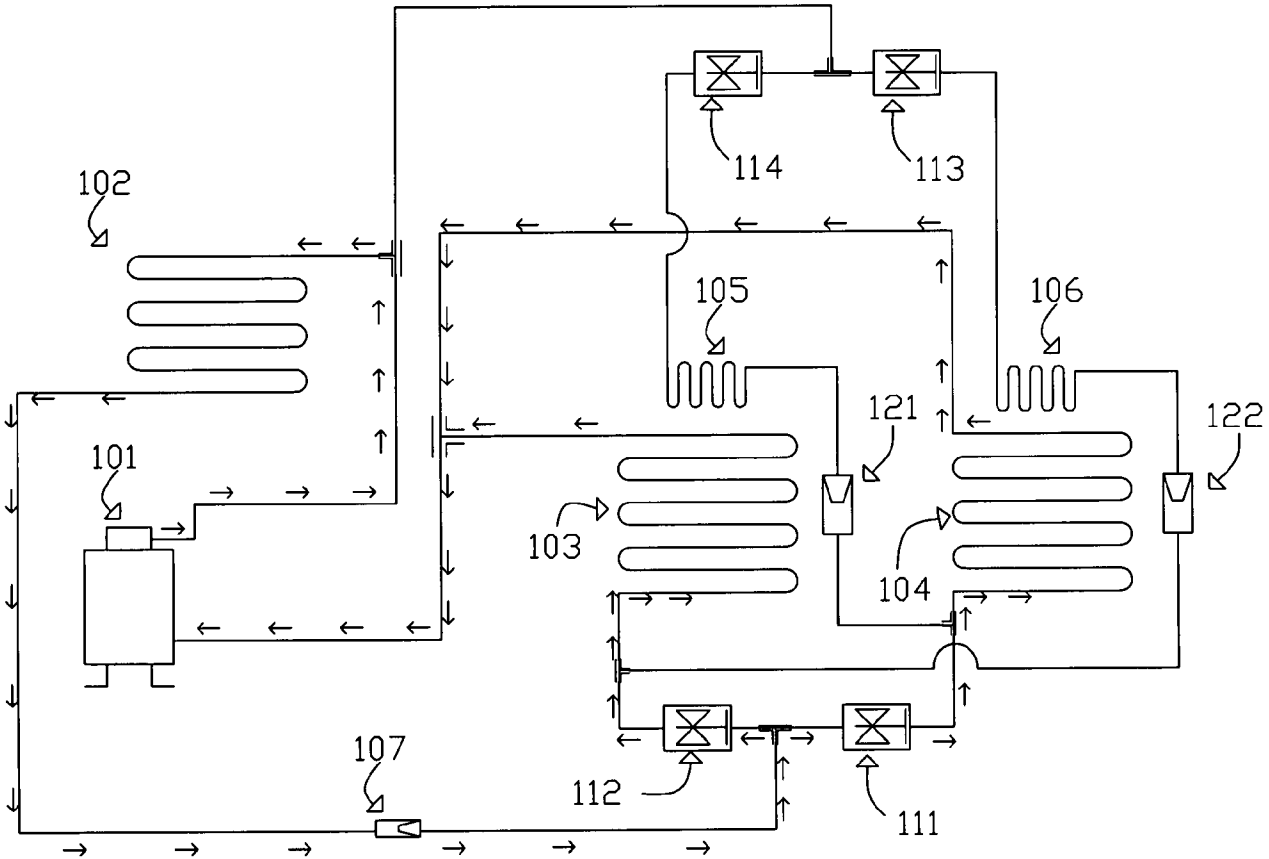
FIG. 1A to FIG. 1E are the illustrative diagrams of the composite-evaporator type cross-defrosting system constructed of refrigerant-defrost type composite-evaporators; the control logics of said system is provided in Table.1 as a reference.

Table.1 demonstrates the control scheme of the first embodiment in each process of cross-refrigerant defrosting process.

DETAILED DESCRIPTION OF THE PREFERRED EMBODIMENTS

Now referring to FIG. 1A to FIG. 1E and Table.1 for the first embodiment, which is the composite-evaporator type cross-defrosting system constructed of refrigerant-defrost type composite-evaporators; the control logics of said system is provided in Table.1 as a reference.

The first embodiment also operates with a control system that changes the defrosting methods according to the outdoor temperature and humidity; when the outdoor temperature is in the range of 20 degree Celsius to 0 degree Celsius, the control system can apply the first defrosting method, which is also called as the cross-air defrosting process; when the outdoor temperature is in the range of 10 degree Celsius to negative 40 degree Celsius, the control system can apply the second defrosting method, which is also called as the cross-refrigeration defrosting process; the threshold at which the control system switches between the cross-air defrosting process and the cross-refrigeration defrosting process can be adjust at any point between 10 degree Celsius to 0 degree Celsius.

The composite-evaporator type cross-defrosting system comprising the following basic components: main compressor 101, main condenser 102, first composite-evaporator 103, second composite-evaporator 104, main expansion valve 107, first control valve 112, second control valve 111, first defrost-flow valve 114, second defrost-flow valve 113, first expansion valve 121, second expansion valve 122, first venting fan (not shown), second venting fan (not shown), outdoor temperature sensor (not shown), separate heat insulation means for each of said composite-evaporators, a control system for selecting and commencing the defrost-cycles of the cross-air defrosting process and the cross-refrigeration defrosting process.

The first composite-evaporator 103 is constructed of one set of evaporation coil and one set of defrost-condensation coil 105, said evaporation coil and said defrost-condensation coil 105 will share the radiator fins so that the heat energy can be transferred from said defrost-condensation coil to said evaporation coil during the cross-refrigeration defrosting process of the first composite-evaporator 103; the defrost-condensation coil 105 of the first composite-evaporator 103 will be referred as the first defrost-condenser 105.

The second composite-evaporator 104 is constructed of one set of evaporation coil and one set of defrost-condensation coil 106, said evaporation coil and said defrost-condensation coil 106 will share the radiator fins so that the heat energy can be transferred from said defrost-condensation coil to said evaporation coil during the cross-refrigeration defrosting process of the second composite-evaporator 104; the defrost-condensation coil 106 of the first composite-evaporator 104 will be referred as the second defrost-condenser 106.

Now referring to FIG. 1A for the full capacity heating operation when both the first composite-evaporator 103 and second composite-evaporator 104 are operating with the evaporation process; the evaporation coil of the first composite-evaporator 103 and the evaporation coil of the second composite-evaporator 104 are enabled by opening the first control valve 112 and second control valve 111; the first defrost-condenser 105 and the second defrost-condenser 106 are disabled by shutting the first defrost-flow valve 114 and the second defrost-flow valve 113; the first venting fan and the second venting fan will be operating to provide the outdoor-air into the heat insulated space of the first composite evaporator 103 and the heat insulated space of the second composite-evaporator 104; the main compressor 101 and the main condenser 102 will be operating with the pressurization process and the condensation process respectively to provide the heat energy for the air-conditioning or heating.

Figure 1B:
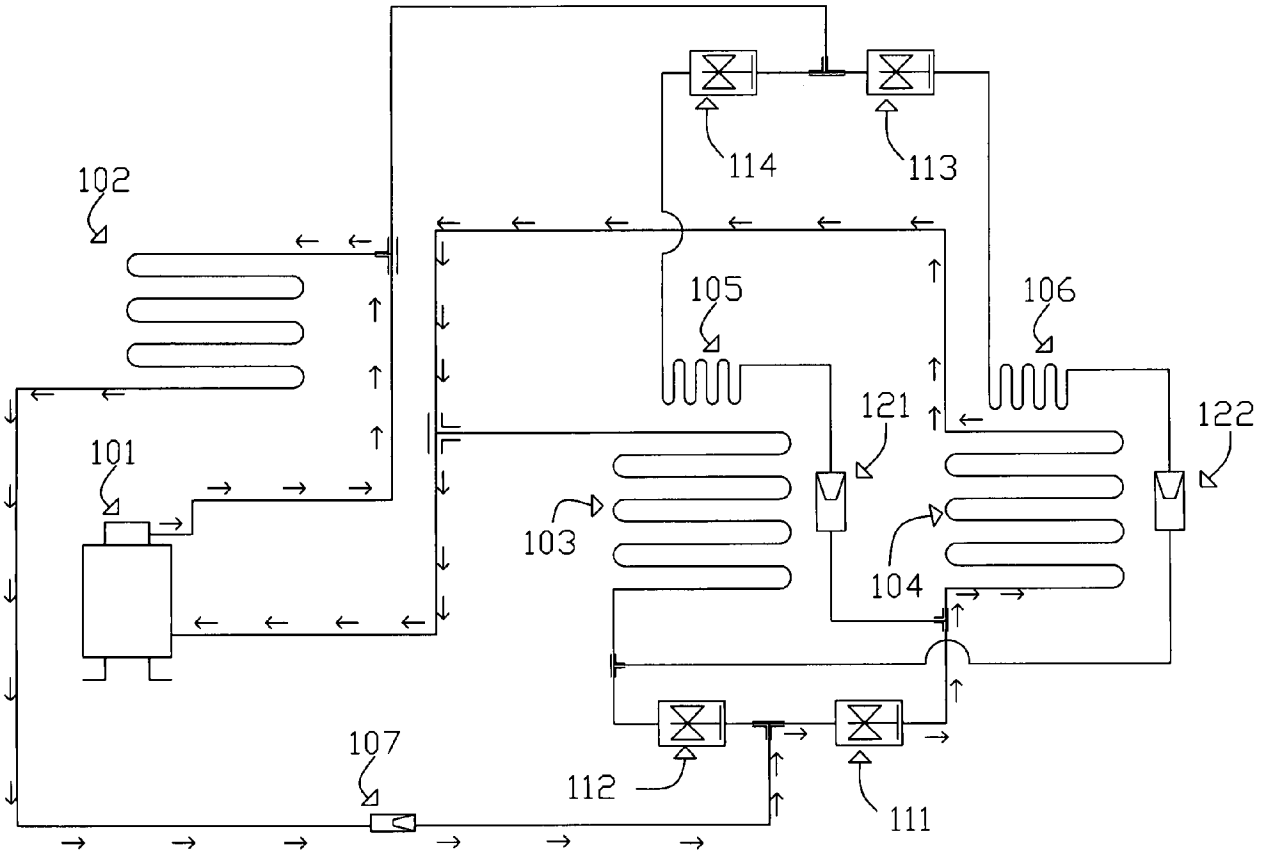
Figure 1C:
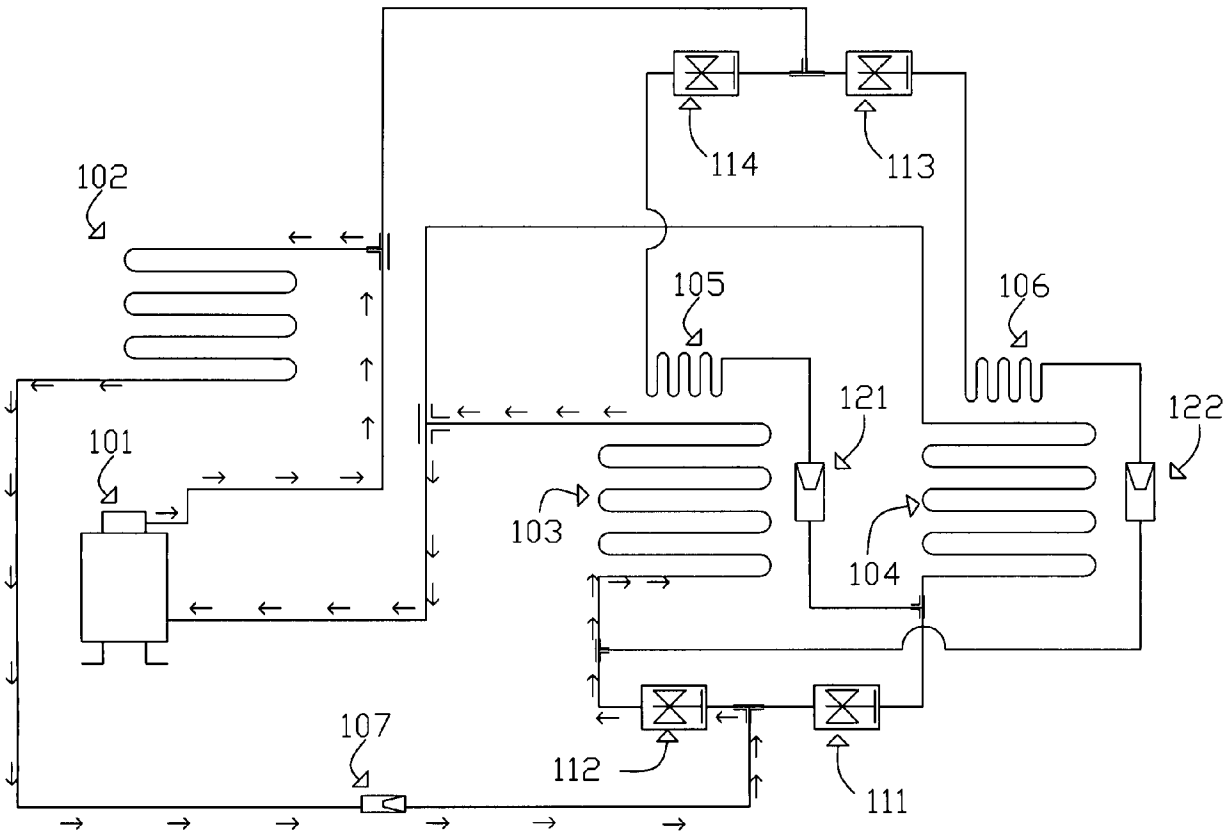

Now referring to FIG. 1B and FIG. 1C for the cross-air defrosting process of the first embodiment; the control system can employ said cross-air defrosting process when the outdoor temperature is between 20 degree Celsius and 0 degree Celsius; during the defrost-cycle of the cross-air defrosting process, the control system will defrost each evaporator with a defrost-cycle as follows; the first composite-evaporator 103 defrosts with the cross-air defrosting process for 5 minute (this duration is only for demonstration purpose and not to be considered as limitation or element) as shown in FIG. 1B, and next the second composite-evaporator 104 defrosts with the cross-air defrosting process for 5 minute as shown in FIG. 1C, and next the first composite-evaporator 103 and the second composite-evaporator 104 will resume the evaporation process as shown in FIG. 1A or repeat the defrost-cycle if the weather condition requires continuous defrost-cycle.

As shown in FIG. 1B, the first composite-evaporator 103 is defrosting with the cross-air defrosting process; the evaporation coil of the first composite-evaporator 103 is disabled, and the outdoor-air will be drawn into the heat insulated space of the first composite-evaporator 103 to melt the accumulated frost on the first composite-evaporator 103; the second composite-evaporator 104 will operate with the evaporation process to provide the evaporated refrigerant to the main compressor 101; the main compressor 101 and the main condenser 102 will continue the pressurization process and the condensation process respectively for the air-conditioning; the first defrost-condenser 105 and the second defrost-condenser 105 will remain disabled during the defrost cycle of the cross-air defrosting process.

As shown in FIG. 1C, the second composite-evaporator 104 is defrosting with the cross-air defrosting process; the evaporation coil of the second composite-evaporator 104 is disabled, and the outdoor-air will be drawn into the heat insulated space of the second composite-evaporator 104 to melt the accumulated frost on the second composite-evaporator 104; the first composite-evaporator 103 will operate with the evaporation process to provide the evaporated refrigerant to the main compressor 101; the main compressor 101 and the main condenser 102 will continue the pressurization process and the condensation process respectively for the air-conditioning; the first defrost-condenser 105 and the second defrost-condenser 106 will remain disabled during the defrost cycle of the cross-air defrosting process.

Figure 1D:
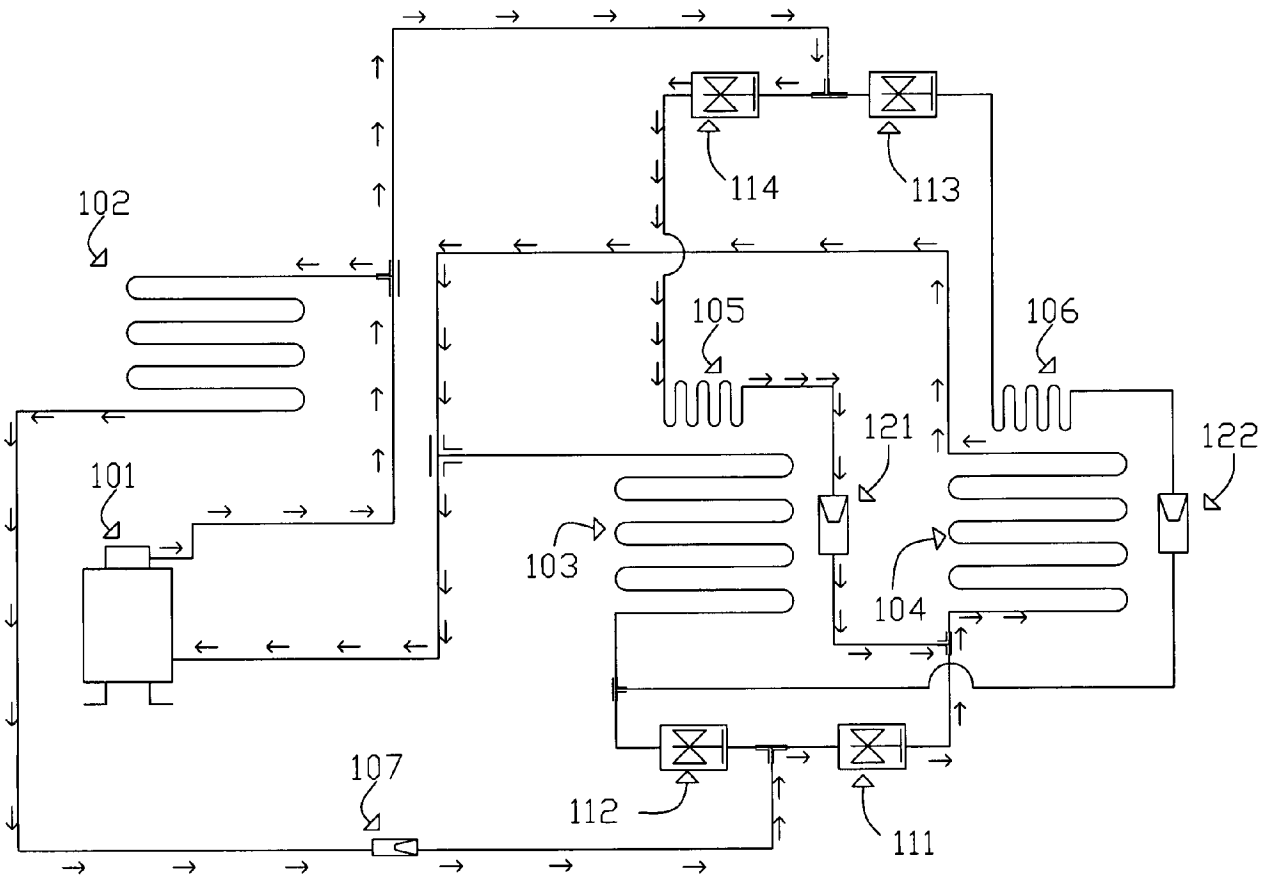
Figure 1E:
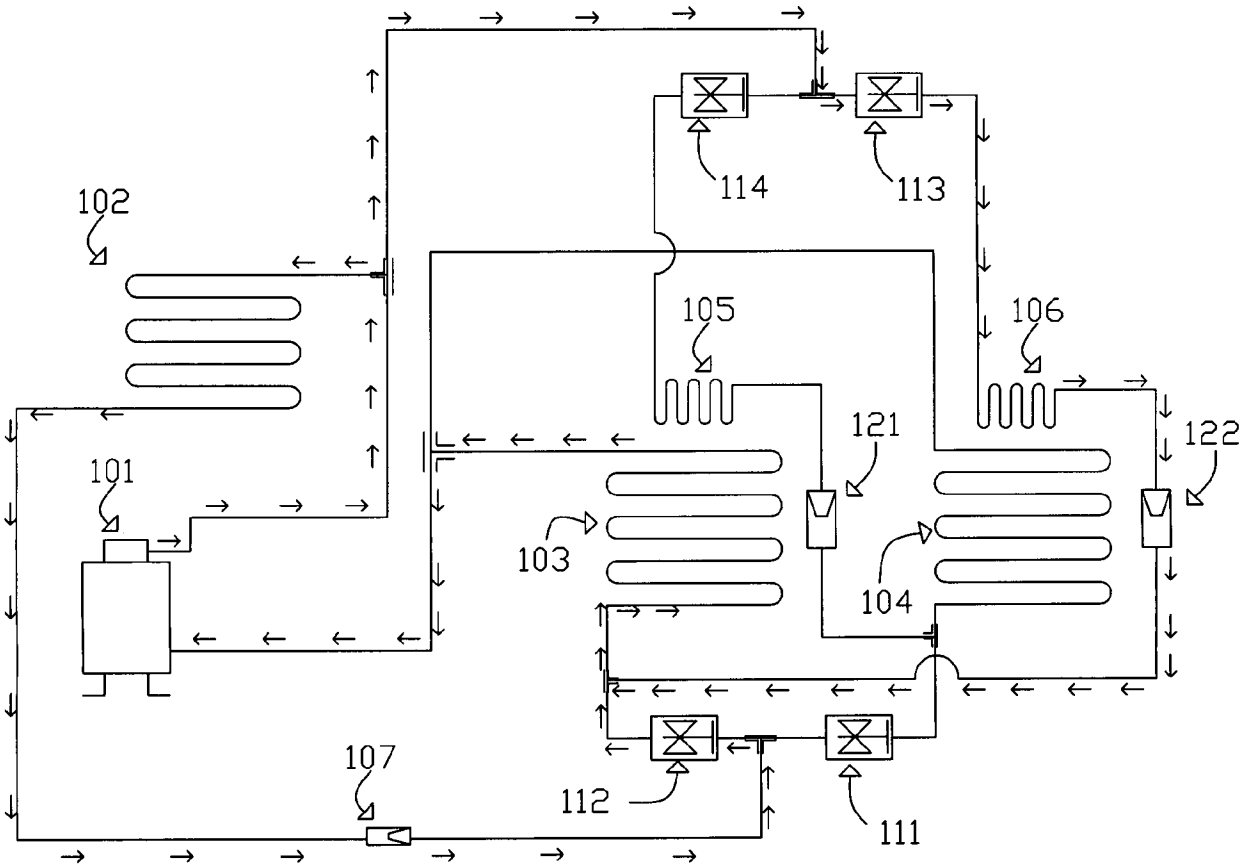

Now referring to FIG. 1D and FIG. 1E for the second defrosting method (the continuous defrost-cycle of the cross-refrigeration defrosting process); when the outdoor temperature drops below the threshold for initiating the cross-refrigeration defrosting process, the control system will commence a defrost-cycle as follows; the first composite-evaporator 103 and the second composite-evaporator 104 will operate with the evaporation process as shown in FIG. 1A for 10 minute, and next the first composite-evaporator 103 defrosts with the cross-refrigeration defrosting process as shown in FIG. 1D for 2 minute (this time duration is only for demonstration purpose and not to be a limitation or element), and next the second composite-evaporator 104 defrosts with the cross-refrigeration defrosting process as shown in FIG. 1E for 2 minute, and next the control system will repeat the defrost-cycle until further change in the outdoor environment is detected.

The basic concept of the cross-refrigeration defrosting process is to distribute a controlled flow of the pressurized refrigerant into the defrost-condensation coil of the composite-evaporator that is defrosting, so that the accumulated frost on said composite-evaporator will melt by the heat energy transferred from its associated defrost-condenser, therefore, the time necessary for the defrosting process will be greatly shortened; the other evaporator of the system will continue the evaporation process with its associated evaporation coil, the main compressor and the main condenser will also continue their operation to generate the heat energy for the air-conditioning. The defrost-cycle of the cross-refrigeration defrosting process requires each evaporator to alternate its operation at a time interval, and the control schemes of each process are provide in FIG. 1D and FIG. 1E.

As shown in FIG. 1D, the first composite-evaporator 103 is defrosting with the cross-refrigeration defrosting process; the first composite-evaporator 103 will disable its associated evaporation coil and enable the first defrost-condenser 105 by opening the first defrost-flow valve 114; a controlled flow of pressurized refrigerant is distributed from the main compressor 101 to the first defrost-condenser 105, and said flow of pressurized refrigerant will release heat energy in the first defrost-condenser 105 to transfer a heat current to the evaporation coil of the first composite-evaporator 103, and next the first defrost-condenser 105 will transfer the refrigerant therein to the evaporation coil of the second composite-evaporator 104 via the first expansion valve 121; the first venting fan will decrease speed or stop the air-flow from outdoor, thereby conserving the heat air inside the heat insulated space of the first composite-evaporator 103, thus creating a hot environment; the second composite-evaporator 104 will receive the refrigerant-flow from the main expansion valve 107 and the refrigerant-flow from the first expansion valve 121; in other words, the main condenser 102 and the first defrost-condenser 105 will be condensing refrigerant to generate heat energy for the air-conditioning and the cross-refrigeration defrosting process respectively, while the second composite-evaporator 104 will be operating with the evaporation process by absorbing the heat from the outdoor-air; the second defrost-condenser 106 is disabled by shutting the second defrost-flow valve 113.

As shown in FIG. 1E, the second composite-evaporator 104 is defrosting with the cross-refrigeration defrosting process; the second composite-evaporator 104 will disable its associated evaporation coil and enable the second defrost-condenser 106 by opening the second defrost-flow valve 113; a controlled flow of pressurized refrigerant is distributed from the main compressor 101 to the second defrost-condenser 106, and said flow of pressurized refrigerant will release heat energy in the second defrost-condenser 106 to transfer a heat current to the evaporation coil of the second composite-evaporator 104, and next the second defrost-condenser 106 will transfer the refrigerant therein to the evaporation coil of the first composite-evaporator 103 via the second expansion valve 122; the second venting fan will decrease speed or stop the air flow from outdoor, thereby conserving the heat air inside the heat insulated space of the second composite-evaporator 104, thus creating a hot environment; the first composite-evaporator 103 will receive the refrigerant-flow from the main expansion valve 107 and the refrigerant-flow from the second expansion valve 122; in other words, the main condenser 102 and the second defrost-condenser 106 will be condensing refrigerant to generate heat energy for the air-conditioning and the cross-refrigeration defrosting process respectively, while the first composite-evaporator 103 will be operating with the evaporation process by absorbing the heat from the outdoor-air; the first defrost-condenser 105 is disabled by shutting the first defrost-flow valve 114.

Figure 1G:
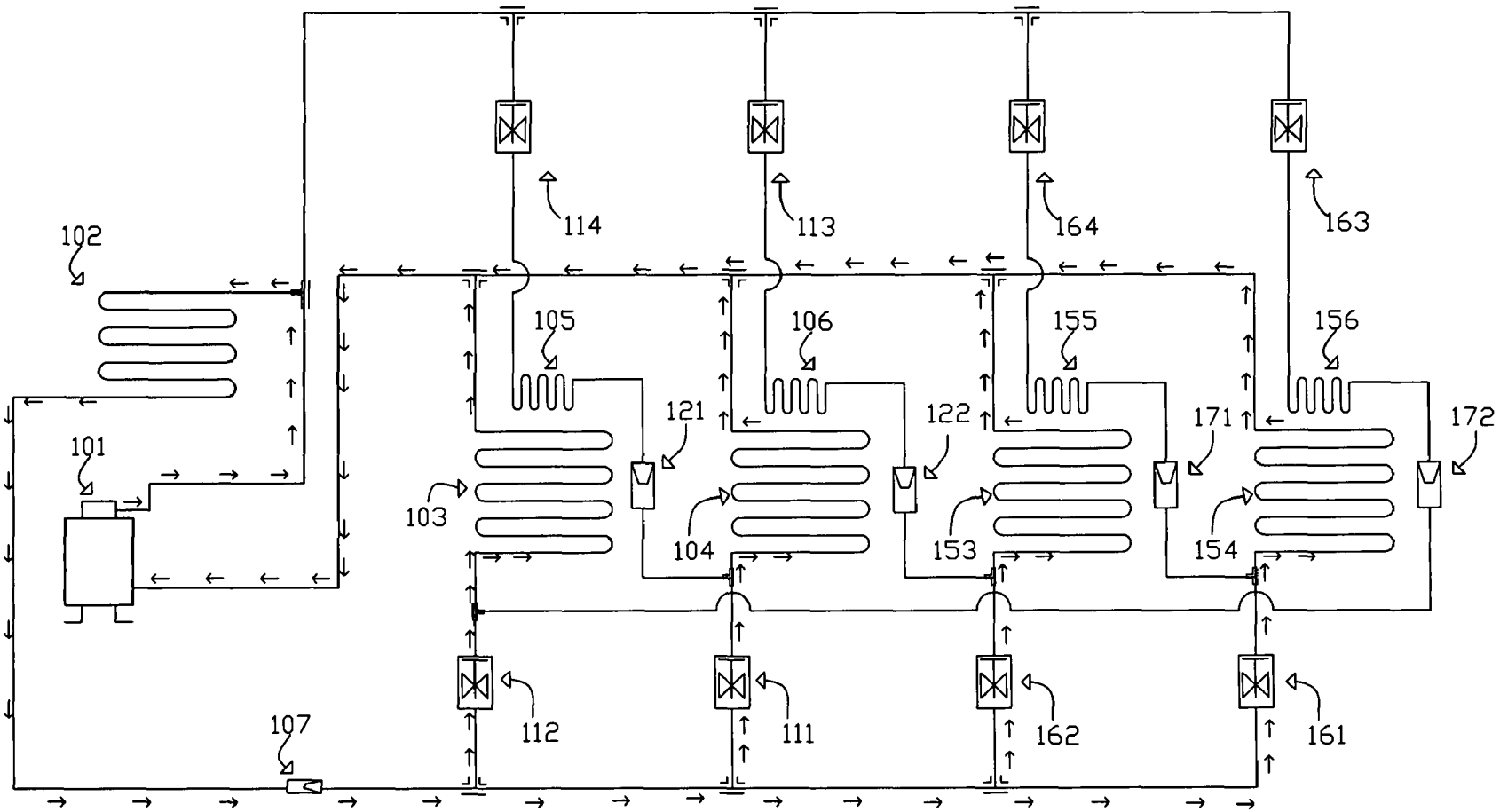
FIG. 1G is an alternative construction scheme of the first embodiment with four composite-evaporators.

The first embodiment of the present invention can be further extended with additional composite evaporators, and the control system can adjust accordingly to the basic concept of the present invention; when one of the evaporators is frosted and requires to defrost with the cross-refrigeration defrosting process, said frosted composite-evaporator will disable its associated evaporation coil and enable its associated defrost-condenser to initiate a controlled flow of pressurized refrigerant from the main compressor, said defrost condenser will conduct a heat current through its radiator fins to said frosted composite-evaporator, and the heat insulated space of said frosted evaporator will control the operation speed of its associated venting fan to conserve the heat air therein, meanwhile, all other composite-evaporators can continue the evaporation process with their associated evaporation coils to absorb heat energy from the outdoor-air, the main compressor and the main condenser will continue their operation for the air-conditioning or heating; the control system will also operate with a continuous defrost-cycle, wherein each composite-evaporator will take turns to operate with the cross-refrigeration defrosting process; an example of the defrost cycle is demonstrated as follows, all composite-evaporators operate with the evaporation process for 10 minute, and next the first composite-evaporator defrosts for 2 minute, next the second composite-evaporator defrosts for 2 minute, and next the third composite-evaporator defrosts for 2 minute, and next the fourth composite-evaporator defrosts for 2 minute, and next the control system repeats the defrost-cycle or adjust its operation if further change in the weather condition is detected. A construction scheme is provided in FIG. 1G for an alternative construction of the first embodiment consisting of four composite-evaporators, wherein the third composite-evaporator 153 has one set of evaporation coil and one set of defrost-condensation coil 155, the fourth composite-evaporator 172 has one set of evaporation coil and one set of defrost-condensation coil 156, the third control valve 162 will disable the refrigerant passage to the evaporation coil of the third composite-evaporator 153 during the cross-air defrosting process and the cross-refrigerant defrosting process of the third composite-evaporator 153, the fourth control valve 161 will disable the refrigerant passage to the evaporation coil of the fourth composite-evaporator 154; the third defrost-flow valve 164 will enable a refrigerant passage to provide a flow of pressurized refrigerant to the defrost-condensation coil 155 of the third composite-evaporator during the cross-refrigerant defrosting process of the third composite-evaporator 153; the fourth defrost-flow valve 163 will enable a refrigerant passage to provide a flow of pressurized refrigerant to the defrost-condensation coil 156 of the fourth composite-evaporator 154 during the cross-refrigerant defrosting process of the fourth composite-evaporator 154.

For easier maintenance and cost reduction, most control valves can be combined into one single rotary valve or other multi-port control valve means, for instance, the first defrost-flow valve 114 and the second defrost-flow valve 113 can be constructed with one multi-port control valve of the identical functionality, and the first control valve 112 and second control valve 111 can also be constructed with one multi-port control valve of the identical functionality.

The control system can further employ the sensor means for the progress of the defrosting process to detect if a composite-evaporator has melted all the frost thereon, if the frost is completely melted, the control system can be reset to the next step of the defrost-cycle; said sensor means can be a pressure or temperature sensor in the composite evaporator.

It should be understood that the threshold temperatures for initiating each defrosting method are different for other regions in the world, where the humidity and frosting condition are the main factor deciding which defrosting method to apply at different temperature range.

TABLE 1

Part.1 Control logics of the second embodiment

| Label | Component Name | Full capacity heating operation | Cross-air defrosting process of first composite evaporator | Cross-air defrosting process of Second composite evaporator |
|---|---|---|---|---|
| 102 | Main condenser | Condensation Process | Condensation Process | Condensation Process |
| 103 | First composite-evaporator | Evaporation Process (evaporation coil enabled) | Defrosting with outdoor-air (evaporation coil disabled) | Evaporation Process (evaporation coil enabled) |
| 104 | Second composite-evaporator | Evaporation Process (evaporation coil enabled) | Evaporation Process (evaporation coil enabled) | Defrosting with outdoor-air (evaporation coil disabled) |
| 114 | First defrost-flow valve | Closed | Closed | Closed |
| 113 | Second defrost-flow valve | Closed | Closed | Closed |
| 112 | First control valve | Open | Closed | Open |
| 105 | First defrost-condenser | No refrigerant-flow | No refrigerant-flow | No refrigerant-flow |
| 111 | Second control valve | Open | Open | Closed |
| 106 | Second defrost-condenser | No refrigerant-flow | No refrigerant-flow | No refrigerant-flow |
| | First venting fan | Full speed | Full speed | Full speed |
| | Second venting fan | Full speed | Full speed | Full speed |

TABLE 1

Part.2 Control logics of the second embodiment

| Label | Component Name | Full capacity heating operation | Cross-refrigerant defrosting process of first composite evaporator | Cross-refrigerant defrosting process of second composite evaporator |
|---|---|---|---|---|
| 102 | Main condenser | Condensation Process | Condensation Process | Condensation Process |
| 103 | First composite-evaporator | Evaporation Process (evaporation coil enabled) | Defrosting by first defrost-condenser (evaporation coil disabled) | Evaporation Process (evaporation coil enabled) |
| 104 | Second composite-evaporator | Evaporation Process (evaporation coil enabled) | Evaporation Process (evaporation coil enabled) | Defrosting by second defrost-condenser (evaporation coil disabled) |
| 114 | First defrost-flow valve | Closed | Open | Closed |
| 113 | Second defrost-flow valve | Closed | Closed | Open |
| 112 | First control valve | Open | Closed | Open |
| 105 | First defrost-condenser | No refrigerant-flow | Condensation Process | No refrigerant-flow |
| 111 | Second control valve | Open | Open | Closed |
| 106 | Second defrost-condenser | No refrigerant-flow | No refrigerant flow | Condensation Process |
| | First venting fan | Full speed | Decreasing speed or stop to conserve heat | Full speed |
| | Second venting fan | Full speed | Full speed | Decreasing speed or stop to conserve heat |

The invention claimed is:

1. A multi-range composite-evaporator type cross-defrosting system comprising:

a) a refrigeration circuit comprising of four sections, which are a refrigerant-compressing section, a refrigerant-condensing section, a refrigerant-evaporating section, and a cross-defrosting section; said refrigerant-compressing section provides a flow of pressurized-refrigerant to said refrigerant-condensing section and said cross-defrosting section; said refrigerant-condensing section will condense said flow of pressurized-refrigerant therein, and release the heat energy for air-conditioning; said refrigerant-condensing section provides a flow of refrigerant to said refrigerant-evaporating section; said refrigerant-evaporating section absorbs heat from the outdoor environment and evaporates said flow of refrigerant therein, and then produces a flow of evaporated-refrigerant into said refrigerant-compressing section;

b) said refrigerant-compressing section comprises at least one compressor (101);

c) said refrigerant-condensing section comprises at least one main condenser (102);

d) said refrigerant-evaporating section comprises at least two composite-evaporator units, which are first composite-evaporator (103) and second composite-evaporator (104); each of said composite-evaporator consists of one set of evaporation coil and one set of defrost-condensation coil;

e) said cross-defrosting section comprises one refrigerant passage from said main compressor (101) to the defrost-condensation coil (105) of first composite-evaporator (103) and one refrigerant passage from said main compressor (101) to the defrost-condensation coil (106) of second composite-evaporator (104);

f) flow control means for independently initiating a flow of pressurized refrigerant from said refrigerant-compressing section to the defrost-condensation coil (105) of said first composite-evaporator (103) during cross-refrigerant defrosting process of said first composite-evaporator (103);

g) flow control means for independently initiating a flow of pressurized refrigerant from said refrigerant-compressing section to the defrost-condensation coil (106) of said second composite-evaporator (104) during cross-refrigerant defrosting process of said second composite-evaporator (104);

h) flow control means for independently disabling the refrigerant passage from said main compressing section to the evaporation coil of first composite-evaporator (103) during the cross-air defrosting process of first composite-evaporator (103) and the cross-refrigerant defrosting process of first composite-evaporator (103);

i) flow control means for independently disabling the refrigerant passage from said main compressing section to the evaporation coil of second composite-evaporator (104) during the cross-air defrosting process of second composite-evaporator (104) and the cross-refrigerant defrosting process of second composite-evaporator (104);

j) a control system for commencing a defrost-cycle of cross-refrigerant defrosting process by controlling said flow control means and outdoor-air-intake means.

2. A multi-range composite-evaporator type cross-defrosting system as defined in claim 1, wherein; each composite-evaporator units includes individual heat insulation, each said outdoor-air-intake means will decrease the rate of venting during the cross-refrigerant defrosting process of its associated composite-evaporator.

3. A multi-range composite-evaporator type cross-defrosting system as defined in claim 1 further comprising:

a) additional composite-evaporators, which includes one set of evaporation coil and one set of defrost-condensation coil;

b) flow control means and refrigerant-passages for said additional composite-evaporators to commence the cross-refrigerant defrosting process.

4. A multi-range composite-evaporator type cross-defrosting system as defined in claim 3, wherein; when one of said composite-evaporators is defrosting with the cross-refrigerant defrosting process, this defrosting composite-evaporator will disable its associated evaporation coil and enable its associated defrost-condensation coil, and this defrost-condensation coil will generate a flow of refrigerant to the evaporation coil of other composite evaporators.

5. A multi-range composite-evaporator type cross-defrosting system as defined in claim 3; said control system will employ a continuous defrost-cycle of the cross-refrigerant defrosting process when the outdoor temperature is from 10 degree Celsius to negative 40 degree Celsius.

6. A multi-range composite-evaporator type cross-defrosting system as defined in claim 3, wherein; said control system will employ a continuous defrost-cycle of the cross-air defrosting process when the outdoor temperature is from 20 degree Celsius to 0 degree Celsius.

7. A multi-range composite-evaporator type cross-defrosting system as defined in claim 3, wherein; each of said composite-evaporators can further comprise sensor means for detecting the progress of the defrosting process; and said control system can adjust the defrost-cycle accordingly for optimum heating efficiency.

8. A multi-range composite-evaporator type cross-defrosting system comprising:

a) a refrigeration circuit comprising of four sections, which are a refrigerant-compressing section, a refrigerant-condensing section, a refrigerant-evaporating section, and a cross-defrosting section;

b) said refrigerant-compressing section comprises at least one compressor (101);

c) said refrigerant-condensing section comprises at least one main condenser (102);

d) said refrigerant-evaporating section comprises at least two composite-evaporator units, which are first composite-evaporator (103) and second composite-evaporator (104); each of said composite-evaporator consists of one set of evaporation coil and one set of defrost-condensation coil;

e) said cross-defrosting section comprises one refrigerant passage from said main compressor (101) to the defrost-condensation coil (105) of first composite-evaporator (103) and one refrigerant passage from said main compressor (101) to the defrost-condensation coil (106) of second composite-evaporator (104);

f) flow control means for independently initiating a flow of pressurized refrigerant from said refrigerant-compressing section to the defrost-condensation coil (105) of said first composite-evaporator (103) during cross-refrigerant defrosting process of said first composite-evaporator (103);

g) flow control means for independently initiating a flow of pressurized refrigerant from said refrigerant-compressing section to the defrost-condensation coil (106) of said second composite-evaporator (104) during cross-refrigerant defrosting process of said second composite-evaporator (104);

h) flow control means for independently disabling the refrigerant passage from said main compressing section to the evaporation coil of first composite-evaporator (103) during the cross-air defrosting process of first composite-evaporator (103) and the cross-refrigerant defrosting process of first composite-evaporator (103);

i) flow control means for independently disabling the refrigerant passage from said main compressing section to the evaporation coil of second composite-evaporator (104) during the cross-air defrosting process of second composite-evaporator (104) and the cross-refrigerant defrosting process of second composite-evaporator (104);

j) independent air-intake means and heat insulation means for each composite-evaporator for independently heat air conservation during the associated cross-refrigerant defrosting process of each composite evaporator;

k) sensor means for detecting the frost condition of each composite-evaporator, and a control system for adjusting the operation threshold for switching between the defrost-cycle of cross-air defrosting process and the defrost cycle of cross-refrigerant defrosting process, wherein:

during the defrost cycle of cross-refrigerant defrosting process, at least one of said composite-evaporators will continue the refrigerant-evaporation process, thereby sustaining a continuous supply of evaporated refrigerant to said main compressor;

during the defrost cycle of cross-refrigerant defrosting process, the composite-evaporator that is defrosting will enable a flow of pressurized refrigerant to the associated defrost-condenser, and the associated air-intake means will adjust the venting rate of the outdoor air to conserve the heat air inside the associated heat insulation space, thereby creating a hot environment.

9. A multi-range composite-evaporator type cross-defrosting system as defined in claim 8 further comprising:

a) additional composite-evaporators;

b) flow control means and refrigerant-passages for said additional composite-evaporators to commence the cross-refrigerant defrosting process, wherein:

during the defrost-cycle of cross-refrigerant defrosting process, each composite-evaporator will take turns to defrost with the associated defrost-condenser;

during the defrost cycle of the cross-refrigerant defrosting process, the composite-evaporator that is defrosting will enable a flow of pressurized refrigerant to the associated defrost-condenser, while all other composite-evaporators will continue the refrigerant-evaporation process to provide a continuous supply of evaporated refrigerant to the main compressor.

10. A multi-range composite-evaporator type cross-defrosting system as defined in claim 8, wherein; said control system will employ a continuous defrost-cycle of the cross-refrigerant defrosting process when the outdoor temperature is from 10 degree Celsius to negative 40 degree Celsius.

11. A multi-range composite-evaporator type cross-defrosting system:

a) a refrigeration circuit comprising of four sections, which are a refrigerant-compressing section, a refrigerant-condensing section, a refrigerant-evaporating section, and a cross-defrosting section; said refrigerant-compressing section provides a flow of pressurized-refrigerant to said refrigerant-condensing section and said cross-defrosting section; said refrigerant-condensing section will condense said flow of pressurized-refrigerant therein, and release the heat energy for air-conditioning; said refrigerant-condensing section provides a flow of refrigerant to said refrigerant-evaporating section; said refrigerant-evaporating section absorbs heat from the outdoor environment and evaporates said flow of refrigerant therein, and then produces a flow of evaporated-refrigerant into said refrigerant-compressing section;

b) said refrigerant-compressing section comprises at least one compressor (101);

c) said refrigerant-condensing section comprises at least one main condenser (102);

d) said refrigerant-evaporating section comprises at least two composite-evaporator units, which are first composite-evaporator (103) and second composite-evaporator (104); said first composite-evaporator (103) consists of one set of evaporation coil and one set of defrost-condensation coil (105); said second composite-evaporator (104) consists of one set of evaporation coil and one set of defrost-condensation coil (106);

e) said cross-defrosting section comprises one refrigerant passage from said main compressor (101) to the defrost-condensation coil (105) of the first composite-evaporator (103), and said refrigerant passage will be controlled with a first defrost-flow-valve (114) to provide a flow of pressurized refrigerant only during the cross-refrigerant defrosting process of the first composite-evaporator (103);

f) said cross-defrosting section comprises one refrigerant passage from said main compressor (101) to the defrost-condensation coil (106) of the second composite-evaporator (104), and said refrigerant passage will be controlled with a second defrost-flow valve (113) to provide a flow of pressurized refrigerant only during the cross-refrigerant defrosting process of the second composite-evaporator (104);

g) air-intake means and heat insulation means for conserving heat air in the first composite-evaporator (103) when the first composite-evaporator (103) is defrosting with the cross-refrigerant defrosting process;

h) air-intake means and heat insulation means for conserving heat air in the second composite-evaporator (104) when the second composite-evaporator (104) is defrosting with the cross-refrigerant defrosting process;

i) a first control valve (112) for independently disabling the refrigerant passage from said main compressing section to the evaporation coil of first composite-evaporator (103) when the first composite-evaporator (103) is defrosting with the cross-refrigerant defrosting process;

j) a second control valve (111) for independently disabling the refrigerant passage from said main compressing section to the evaporation coil of second composite-evaporator (104) when the second composite-evaporator (104) is defrosting with the cross-refrigerant defrosting process;

k) sensor means for detecting the frost condition of each composite-evaporator;

l) a control system for commencing the full capacity heating operation and the defrost-cycle of the cross-refrigerant defrosting process by controlling said control valves and air-intake means, wherein:

said control system will adjust each process duration of said defrost-cycle of the cross-refrigerant defrosting process according to the frost condition of each composite-evaporator;

during the defrost cycle of the cross-refrigerant defrosting process, at least one of said composite-evaporators will continue the refrigerant-evaporation process, thereby sustaining a continuous supply of evaporated refrigerant to said main compressor (101);

during the defrost cycle of the cross-refrigerant defrosting process, the composite-evaporator that is defrosting will enable a flow of pressurized refrigerant to the associated defrost-condenser, and the associated air-intake means will adjust the venting rate of the outdoor air to conserve the heat air inside the associated heat insulation space, thereby creating a hot environment;

during the defrost cycle of the cross-refrigerant defrosting process, the defrost-condenser associated with the composite-evaporator that is defrosting will receive a flow of pressurized refrigerant from said main compressor (101), said flow of pressurized refrigerant will condense and be circulated to the other composite-evaporator of said refrigerant-evaporating section via pressure regulating means.

12. A multi-range composite-evaporator type cross-defrosting system as defined in claim 11 further comprising:

a) additional composite-evaporators;

b) flow control means and refrigerant-passages for said additional composite-evaporators to commence the cross-refrigerant defrosting process, wherein:

during the defrost-cycle of cross-refrigerant defrosting process, each composite-evaporator will take turns to defrost with the associated defrost-condenser;

during the defrost cycle of the cross-refrigerant defrosting process, the composite-evaporator that is defrosting will enable a flow of pressurized refrigerant to the associated defrost-condenser, while all other composite-evaporators will continue the refrigerant-evaporation process to provide a continuous supply of evaporated refrigerant to the main compressor.

13. A multi-range composite-evaporator type cross-defrosting system as defined in claim 11, wherein; said first defrost-flow valve (114) and second defrost-flow valve (113) are constructed as one multi-port control valve.

14. A multi-range composite-evaporator type cross-defrosting system as defined in claim 11, wherein; said first control valve (112) and second control valve (111) are constructed as one multi-port control valve.

* * * * *